United States Patent [19]

Shigehara et al.

[11] Patent Number: 4,669,121

[45] Date of Patent: May 26, 1987

[54] SPEECH SYNTHESIZING APPARATUS

[75] Inventors: Hiroshi Shigehara, Tokyo; Fuminari Tanaka, Kawasaki, both of Japan

[73] Assignee: Tokyo Shibaura Denki Kabushiki Kaisha, Kawasaki, Japan

[21] Appl. No.: 526,798

[22] Filed: Aug. 26, 1983

[30] Foreign Application Priority Data

Aug. 31, 1982 [JP] Japan ..... 57-150950

[51] Int. Cl.[4] ..... G10L 5/00

[52] U.S. Cl. ..... 381/51

[58] Field of Search ..... 381/51–53, 381/36–40; 364/513, 513.5

[56] References Cited

U.S. PATENT DOCUMENTS 4,470,150 9/1984 Ostrowski ..... 381/52

OTHER PUBLICATIONS

Digital Processing of Speech Signals, by Rabiner et al., 1978, pp. 117–118.

*Primary Examiner*—E. S. Matt Kemeny

*Attorney, Agent, or Firm*—Finnegan, Henderson, Farabow, Garrett & Dunner

[57] ABSTRACT

A speech synthesizing apparatus has a first memory storing a plurality of phrase data each including speech data, an address designating circuit for designating an address of the first memory, a second memory for storing synthesizing condition data, and a synthesizer for synthesizing a speech signal based on speech data from the first memory in accordance with the synthesizing condition data stored in the second memory. Each phrase data stored in the first memory also includes the corresponding synthesizing condition data. When each phrase data is read out from the first memory, the synthesizing condition data is first read out and is stored in the second memory, and then the speech data is read out and is supplied to the synthesizer.

8 Claims, 5 Drawing Figures

SPEECH SYNTHESIZING APPARATUS

BACKGROUND OF THE INVENTION

The present invention relates to a speech synthesizing apparatus for synthesizing a speech signal based on speech data stored in a memory.

Conventional techniques of synthesizing speech based on digital data read out from a memory including analyzing-synthesizing methods are known which include linear predictive coding (LPC), partial autocorrelation coding (PARCOR), line spectrum pair coding (LSP), formant coding and the like.

When human speech is synthesized by one of such techniques, speech synthesizing conditions are preset which relate to the length of a speech frame (the period during which a speech signal can be regarded as stationary), the bit rate/frame, bit allocation for each analyzed parameter, the number of stages of a digital filter, and the like. When these speech synthesizing conditions are preset, the following synthesizing conditions can also be preset: the type of a sound source, presence of vocal tract loss, repetitive use of a parameter, the kind of voice (male or female), change in setting a frame length, interpolation of a parameter, the type of tone (speech or melody), setting of pitch (internally generated or externally determined), and an operation method such as a method for rounding the result of calculation.

Other conventional speech synthesizing techniques and waveform coding methods are also known which include adaptive delta-modulation (ADM), delta modulation (DM), adaptive difference pulse code modulation (ADPCM), adaptive predictive coding (APC) and the like. In such techniques, the sampling frequency, bit allocation and the like must be preset as speech synthesizing conditions.

In a conventional speech synthesizing apparatus, prior to speech synthesizing of each phrase, necessary speech synthesizing conditions are preset by a controller, such as a microcomputer, or are manually entered through a keyboard externally connected to the apparatus.

FIG. 1 shows an example of a conventional speech synthesizing apparatus of this type. The apparatus has a control 2, a memory 4 for storing speech data, an address counter 6 for designating an address of the memory 4, a condition memory 8 for storing synthesizing condition data, a parallel-serial (P/S) converter 10, and a synthesizer 12. The control 2 sets in the address counter 6 top address data corresponding to the first speech data of a phrase to be synthesized and also sets the corresponding condition data in the condition memory 8. Thereafter, the control 2 supplies a speech generating instruction to the synthesizer 12. In response to the speech generating instruction, the synthesizer 12 generates a data request signal or pulse train to the P/S converter 10. For example, this data request signal is obtained by passing a reference clock pulse through an AND gate connected to receive a pulse signal which is set high for a predetermined period in each frame period. Then, one-word speech data of n-bits is supplied in parallel to the P/S converter 10 from the memory location in the memory 4 which is designated by an address signal from the address counter 6. The n-bit speech data from the P/S converter 10 is serially supplied to the synthesizer 12. The synthesizer 12 synthesizes a speech signal using the speech data sequentially supplied from the P/S converter 10 in accordance with the synthesizing condition data stored in the condition memory 8.

Upon counting the n drive pulses included in the data request signal, an n-scale counter 14 supplies a pulse to the address counter 6 so as to increase the content of the address counter 6 by one count. Thereafter, the synthesizer 12 continues to generate drive pulses so as to synthesize a speech signal using the subsequent n-bit speech data supplied from the memory 4 through the P/S converter 10. In this manner, the synthesizer 12 counts up by one the content of the address counter 6 and simultaneously synthesizes a speech signal based on the speech data read out from the memory 4 for each word, while the resultant speech signal is supplied to an electric-acoustic converter (not shown).

In the conventional speech synthesizing apparatus as described above, the control 2 is required to set the synthesizing condition data in the condition memory 8, to set the top address data for designating the initial memory location storing the speech data of a selected phrase, to supply the speech generating instruction to the synthesizer 12, and so on. However, in a general microcomputer for controlling the control 2, the speech synthesizing function is a subfunction, and the control function is the main function.

The main function of a microcomputer is, for example, temperature control in an air conditioner system, high frequency output control in an electronic oven, and accurate delivery discrimination of various goods upon insertion of money by a customer in an automatic vending machine. Accordingly, when complex control such as phrase editing or the like must be executed by the control 2, the work loads of the control 2 and the microcomputer for setting predetermined synthesizing condition data therein are significantly increased.

SUMMARY OF THE INVENTION

It is an object of the present invention to provide a speech synthesizing apparatus which is capable of reducing the work load of a control to the minimum.

The above object of the present invention can be achieved by a speech synthesizing apparatus comprising a memory for storing speech condition data and speech data for each phrase, and a synthesizer for synthesizing a speech signal based on the speech data from said memory in accordance with the corresponding synthesizing condition data which is read out from the memory for each selected phrase.

According to the present invention, the synthesizing condition data and the speech data are read out in this order from the memory by designating the top address of each phrase data. Thus, the speech data can be synthesized in accordance with the synthesizing condition data read out from the memory, and the synthesizing condition data need not be supplied externally.

DETAILED DESCRIPTION OF THE PREFERRED EMBODIMENTS

Figure 1:
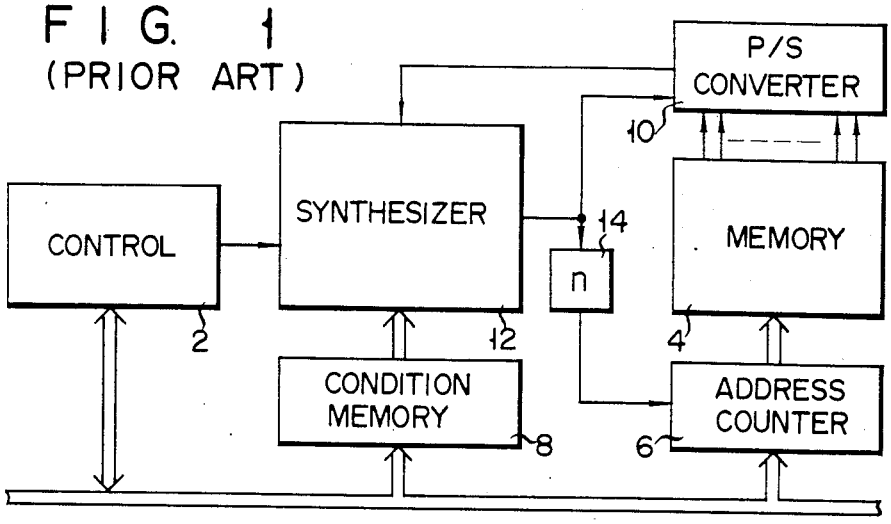
FIG. 1 (PRIOR ART)
FIG. 1 is a block diagram of a conventional speech synthesizing apparatus.
Figure 2:
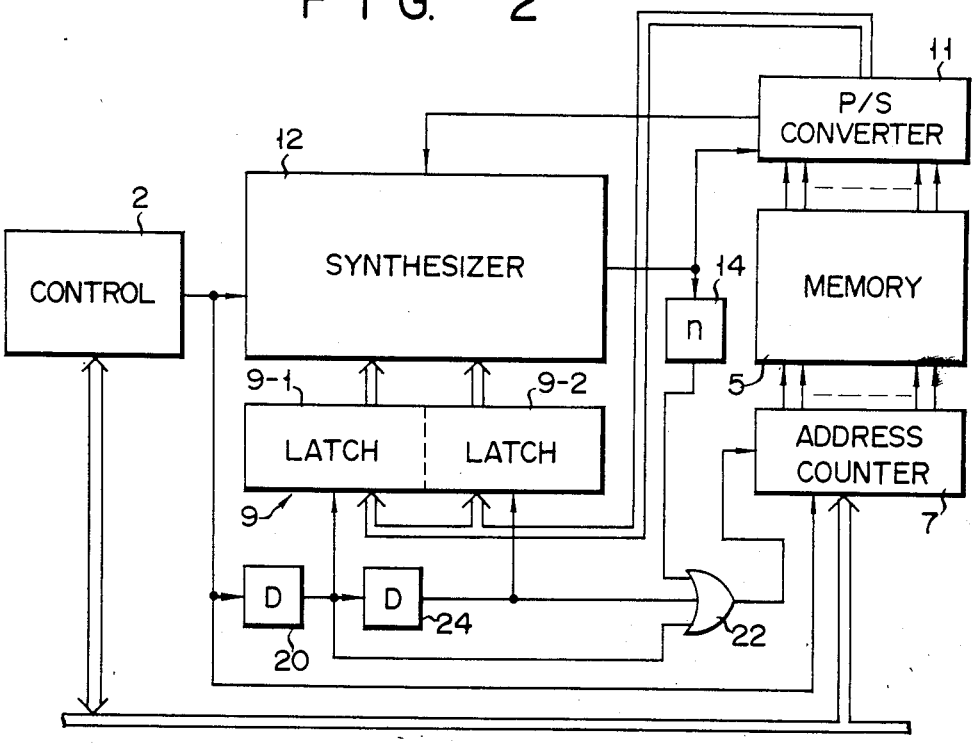
FIG. 2 is a block diagram of a speech synthesizing apparatus according to an embodiment of the present invention.
Figure 3:
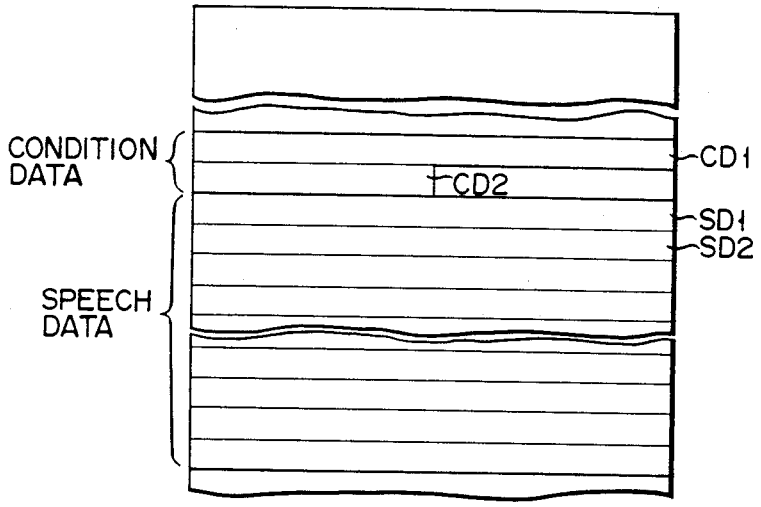
FIG. 3 shows a memory map of a memory used in the apparatus shown in FIG. 2.

FIG. 2 shows a block diagram of a speech synthesizing apparatus according to an embodiment of the present invention. The apparatus includes a control 2, a memory 5, an address counter 7 for designating an address of the memory 5, a condition memory 9 for storing synthesizing condition data, a parallel-serial converter 11, and a synthesizer 12. The memory 5 stores a plurality of phrase data. As shown in FIG. 3, each phrase data includes (n+m)-bit (where m<n) condition data, together with speech data of a plurality of frames. In this case, the memory area preceding the memory area storing speech parameter data may be provided to store condition flag data such as: a parameter repeat flag which represents whether the speech parameter in the corresponding frame is generated on the basis of a preceding speech parameter, a frame length change flag which represents whether the frame length of the corresponding frame must be changed, or a synthesizing completion flag which represents whether the corresponding frame is the final frame, as needed. That is, the speech data of each frame may include condition flag data and speech parameter data following the condition flag data.

In this embodiment, the condition memory 9 includes, for example, an n-bit latch 9-1 and an m-bit latch 9-2. The P/S converter 11 is formed of, for example, an n-stage shift register circuit. In the n-stage shift register circuit, the output terminals of n shift registers are connected to the n-bit input port of the latch 9-1, the output terminals of the upper m shift registers are also connected to the m-bit input port of the latch 9-2, and the output terminal of the final stage shift register is also connected to the input terminal of the synthesizer 12.

A speech generating instruction from the control 2 is supplied to the synthesizer 12 and to the latch terminal of the address counter 7, and is also supplied to the latch 9-1 through a delay circuit 20 as a latch signal. An output signal from the delay circuit 20 is supplied to the count-up terminal of the address counter 7 through an OR gate 22, and is also supplied to the latch 9-2 through another delay circuit 24 as a latch signal. An output signal from the delay circuit 24 is supplied to the count-up terminal of the address counter 7 through the OR gate 22.

When a speech generating instruction is supplied by the control 2, address data from the control 2, which represents the top address of the memory area storing the designated phrase data, is set in the address counter 7. Then, n-bit synthesizing condition data CD1 is read out from the memory location of the memory 5 designated by the address data and is supplied to the P/S converter 11. In response to the speech generating instruction supplied through the delay circuit 20, the latch 9-1 latches n-bit parallel data from the P/S converter 11. Since an output signal from the delay circuit 20 is supplied to the count-up terminal of the address counter 7 through the OR gate 22, the content of the address counter 7 is counted up by one count. Then, the n-bit data including m-bit synthesizing condition data CD2 is read out from the next memory location. The m-bit synthesizing condition data CD2 thus read out from the memory 5 is supplied to the latch 9-2 through the P/S converter 11. In this case, the lower (n−m)-bit data is processed as invalid data. In this state, in response to an output signal from the delay circuit 24, the latch 9-2 latches the m-bit synthesizing condition data CD2. An output signal from the delay circuit 24 is supplied to the count-up terminal of the address counter 7 through the OR gate 22 so as to count up the content of the address counter 7 by one count. Then, the first n-bit speech data SD1 is read out from the memory 5 and is supplied to the P/S converter 11.

When a data request signal including a plurality of drive pulses is generated by the synthesizer in this state, the n-bit speech data which has been stored in the P/S converter 11 is shifted bit by bit and is thus serially supplied to the synthesizer 12. The synthesizer 12 synthesizes a speech signal based on the speech data from the P/S converter 11. Meanwhile, every time an n-scale counter 14 counts n drive pulses included in the data request signal from the synthesizer 12, it supplies an output pulse to the count-up terminal of the address counter 7 through the OR gate 22 to count up the content of the counter 7 by one count. Then, the second speech data SD2 is read out from the memory 5 and is supplied to the P/S converter 11.

When further drive pulses in the data request signal are continuously supplied from the synthesizer 12 to the P/S converter 11, speech data is serially supplied from the P/S converter 11 to the synthesizer 12 in units of bits. As for the data request signals from the synthesizer 12, the first data request signal is generated after predetermined delay times of the delay circuits 20 and 24 from the generation of the speech generating instruction, while the subsequent data request signals are generated at a period corresponding to the frame length. The number of drive pulses of each data request signal required for deriving speech parameter data for each frame is determined in accordance with condition flag data for a corresponding frame. For this purpose, LSI T 6721 (manufactured by TOSHIBA Co.) may be used to construct the synthesizer 12.

In accordance with the synthesizing condition data included in the selected phrase data, the speech data for a plurality of frames in the phrase data is sequentially read out from the memory 5 and is supplied to the synthesizer 12 for synthesis. The synthesized speech signal is then supplied to an electric-acoustic converter (not shown) and the corresponding speech is generated thereby.

Figure 4:
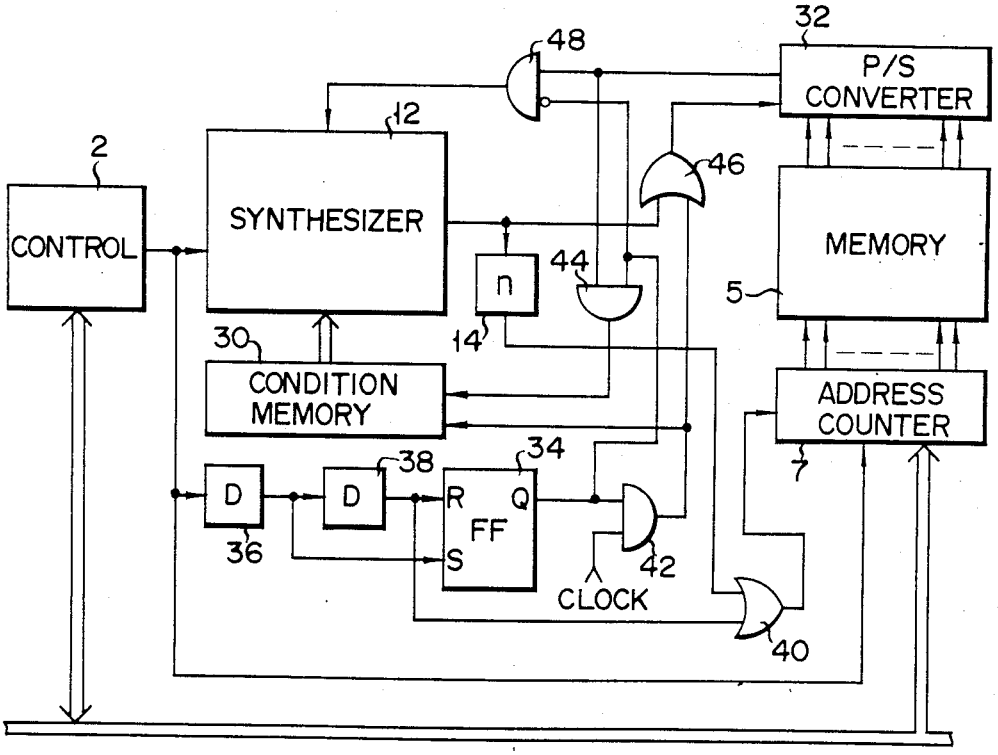
FIG. 4 is a block diagram of a speech synthesizing apparatus according to another embodiment of the present invention.
Figure 5:
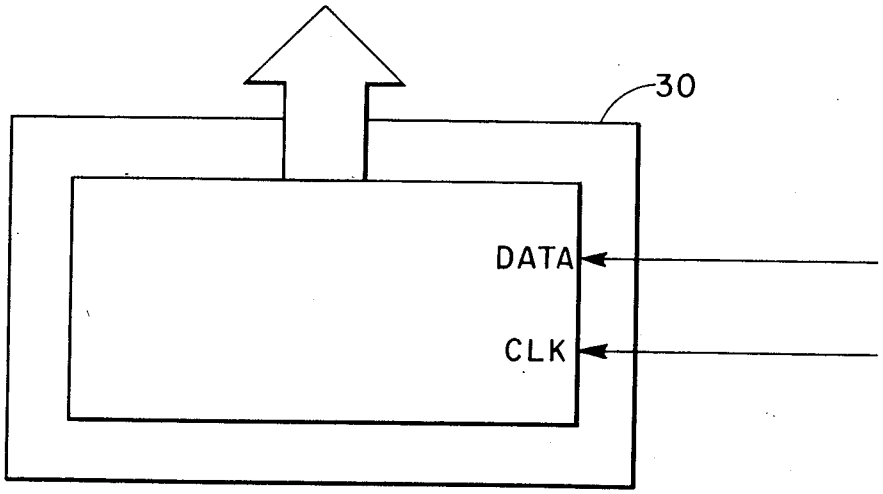
FIG. 5 shows one embodiment of condition memory 30 in FIG. 4 as a serial to parallel converter.

FIG. 4 shows a block diagram of a speech synthesizing apparatus according to another embodiment of the present invention. The apparatus includes a control 2, a memory 5, an address counter 7, a condition memory 30, a parallel-serial (P/S) converter 32, and a synthesizer 12. The condition memory 30 may be, for example, a serial-parallel (S/P) converter formed of an n-stage shift register circuit, as shown in FIG. 5. The P/S converter 32 may be formed of an n-bit shift register circuit.

A speech generating instruction from the control 2 is supplied to the synthesizer 12 and the address counter 7 and is also supplied to the reset input terminal of a flip-flop circuit 34 through delay circuits 36 and 38. The output terminal of the delay circuit 36 is also connected to the set input terminal of the flip-flop circuit 34. The output terminal of the delay circuit 38 is also connected to the count-up terminal of the address counter 7 through an OR gate 40. The Q output terminal of the flip-flop circuit 34 is connected to one input terminal of the each of AND gates 42 and 44. The other input terminal of the AND gate 42 receives a clock signal, and the output terminal of the AND gate is connected to the clock terminal of the condition memory 30 and also to the clock terminal of the P/S converter 32 through an OR gate 46. The other input terminal of the AND gate 44 is connected to the output terminal of the P/S converter 32, and the output terminal of the AND gate 44 is connected to the input terminal of the condition memory 30. The output terminal of the P/S converter 32 is further connected to the data input terminal of the synthesizer 12 through an AND gate 48, one input terminal of which is connected to receive an inverted signal of the Q output signal from the flip-flop 34. A data request signal from the synthesizer 12 is supplied to the clock terminal of the P/S converter 32 through the OR gate 46, and to an n-scale counter 14, the output terminal of which is connected to the count-up terminal of the address counter 7 through the OR gate 40.

In response to phrase designation data from an external data processing circuit (not shown), the control 2 generates the top address data and sets it in the address counter 7. Thereafter, in response to a speech generating instruction received through the delay circuit 36, the flip-flop circuit 34 is set. Then, the flip-flop circuit 34 generates an output signal of high level which enables the AND gates 42 and 44 and disables the AND gate 48. The clock signal fed through the AND gate 42 is supplied to the clock terminal of the condition memory 30 directly and to the clock terminal of the P/S converter 32 through the OR gate 46. Then, the n-bit condition data supplied in parallel to the P/S converter 32 from the memory 5 is shifted and is serially supplied to the condition memory 30 through the AND gate 44.

When n clock pulses have been supplied to the condition memory 30 and the P/S converter 32 through the AND gate 42, that is, the n-bit synthesizing condition data stored in the memory 5 has been completely transferred to the condition memory 30, the flip-flop circuit 34 is reset by an output signal from the delay circuit 38. Thus, the delay circuit 38 is designed to have a delay time corresponding to time for generating n clock pulses.

An output signal of low level from the flip-flop circuit 34 disables the AND gates 42 and 44 and enables the AND gate 48. An output signal from the delay circuit 38 is supplied to the address counter 7 through the OR gate 40 so as to count up the content of the counter 7 by one count. In this manner, the n-bit speech data from the memory 5 is supplied to the P/S converter 32.

After predetermined delay times of the delay circuits 36 and 38 from the generation of a speech generating instruction, the first data request signal including a plurality of drive pulses is supplied to the clock terminal of the P/S converter 32 from the synthesizer 12. The speech data in the P/S converter 32 is shifted and is supplied to the synthesizer 12 through the AND gate 48. When the n-scale counter 14 counts n drive pulses from the synthesizer 12, it supplies an output signal to the address counter 7 through the OR gate 40 so as to count up the content of the counter 7 by one count. Thereafter, as in the embodiment described with reference to FIG. 2, the speech data for one phrase from the memory 5 is supplied to the synthesizer 12 in units of bits for synthesis.

Although the present invention has been described with reference to the particular embodiments, the present invention is not limited to these amendments. For example, in the embodiment shown in FIG. 2, (n+m)-bit synthesizing condition data is used. However, if n-bit synthesizing condition data is used, the latch 9-2 and delay circuit 24 can be omitted. Furthermore, in the embodiment shown in FIG. 4, n-bit synthesizing condition data is used. However, (n+m)-bit synthesizing condition data may also be used. In this case, the apparatus must further include a flip-flop F·F which is set by an output signal from the delay circuit 38, a delay circuit which delays an output signal from the delay circuit 38 by a period corresponding to m pulses and supplies the delayed signal to the count-up terminal of the address counter 7, and an OR gate which receives as inputs the output signals from the flip-flops F F and 34.

In the embodiments shown in FIGS. 2 and 4, the control 2 generates the top address data and the speech generating instruction. However, it is also possible to use, in place of the control 2, a keyboard circuit having keys for setting the top address data and a key for generating a speech generating instruction. In this case, it is possible to manually operate the keyboard circuit to produce speech from the electric-acoustic conversion circuit (not shown).

In the embodiment shown in FIG. 2, the latches 9-1 and 9-2 receive parallel output data from the P/S converter 11. However, parallel output data from the memory 5 may also be directly supplied to latches 9-1 and 9-2.

In the embodiment in FIG. 2, it is possible to omit the P/S converter 11, and to supply the parallel speech data from the memory 5 to the synthesizer 12 through an AND gate circuit which is enabled in response to, for example, a first one of every n drive pulses in the data request signal.

What is claimed is:

1. A speech synthesizing apparatus comprising:

first memory means for storing a plurality of phrase data, each of said phrase data including speech data and all of the synthesizing condition data required for synthesizing said speech data for that phrase data;

address designation means for designating memory locations in said first memory means from which stored synthesizing condition data and speech data are read out;

second memory means coupled to said first memory means for storing said synthesizing condition data read out from said first memory means; and synthesizing means, coupled to said first and second memory means, for synthesizing a speech signal based on said speech data read out from said first memory means in accordance with only said synthesizing condition data stored in said second memory means,

2. An apparatus according to claim 1, wherein the first memory means comprises parallel-to-serial converting means to which a predetermined number of bits of the phrase data is read in parallel from the memory locations of said first memory means designated by the address designation means, said parallel-to-serial converting means being adapted to convert said speech data from parallel to serial form.

3. An apparatus according to claim 1, wherein the second memory means comprises at least one latch circuit for latching the synthesizing condition data read out from the first memory means.

4. An apparatus according to claim 2, wherein:

the parallel-to-serial converting means is further adapted to convert the synthesizing condition data from parallel to serial form; and said second memory means comprises serial-to-parallel converting means for converting serial data from said parallel-to-serial converting means into parallel data.

5. An apparatus according to claim 1, wherein the address designation means comprises:

a presettable address designating circuit, and a top address setting circuit which sets top address data in said presettable address designating circuit.

6. An apparatus according to claim 5, wherein said presettable address designating circuit comprises a presettable counter.

7. A speech synthesizing apparatus comprising:

first memory means for storing a plurality of phrase data, each of said phrase data including speech data and all of the synthesizing condition data required for synthesizing said speech data for that phrase data, said first memory means including parallel-to-serial converting means;

address designation means for designating memory locations in said first memory means from which stored synthesizing condition data and speech data are read out, said address designating means including a presettable address designating circuit comprising a presettable counter, and a top address setting circuit which supplies top address data and sets the top address data in said presettable address designating circuit;

said parallel-to-serial converting means being adapted to receive a predetermined number of bits of said phrase data read in parallel from said memory locations of said first memory means designated by said address designation means, and to convert said speech data from parallel to serial form;

second memory means coupled to said first memory means for storing said synthesizing condition data read out from said first memory means, said second memory means including at least one latch circuit for latching said synthesizing condition data read out from said first memory means; and synthesizing means, coupled to said first and second memory means, for synthesizing a speech signal based on said speech data read out from said first memory means in accordance with only said synthesizing condition data in said second memory means.

8. An apparatus according to claim 7, wherein:

said parallel-to-serial converter means is further adapted to convert said synthesizing condition data from parallel to serial form; and said second memory means comprises serial-to-parallel converting means for converting serial data from said parallel-to-serial converting means into parallel data.

* * * * *